US005615892A

United States Patent [19]

Miller

[11] Patent Number: 5,615,892

[45] Date of Patent: Apr. 1, 1997

[54] BOOMERANG WITH CONSISTENTLY ACCURATE FLIGHT AND RETURN CAPABILITIES

[76] Inventor: William L. Miller, 120 S. Rochelle Ave., Lake Alfred, Fla. 33850

[21] Appl. No.: 564,403

[22] Filed: Nov. 29, 1995

[51] Int. Cl.[6] ..... A63B 65/08

[52] U.S. Cl. ..... 473/590; 446/36

[58] Field of Search ..... 273/424, 425, 273/426, 427, 428; D21/85, 86; 446/36–46

[56] References Cited

U.S. PATENT DOCUMENTS

| | | | |
|---|---|---|---|
| 2,382,347 | 8/1945 | Streater | 446/42 |
| 3,860,203 | 1/1975 | Hyde | 446/44 |
| 4,337,950 | 7/1982 | Gidge | 273/426 |
| 5,254,077 | 10/1993 | Nottingham et al. | 273/424 |
| 5,490,678 | 2/1996 | Darnell | 273/426 |

FOREIGN PATENT DOCUMENTS

| | | | |
|---|---|---|---|
| 699214 | 11/1953 | United Kingdom | 273/426 |

*Primary Examiner*—William M. Pierce

[57] ABSTRACT

A boomerang with three convolute curved blades connected to a central hub, said blades being uniformly shaped and equally spaced about a central axis and has unique airfoil characteristics around the entire peripheral edge, the unique airfoil characteristic is an integral part of this invention; when the boomerang is thrust outwardly in a vertical position, it will create and maintain a forward flight pattern from the point of launching; it subsequently begins an upward flight until it momentarily stalls in the air, then makes a 180 degree turn to the left, reverses its forward flight and simultaneously rotates 90 degrees from vertical, taking on a horizontal, hovering type of flight pattern, and slowly returns to the point of launching; said forward and return flight pattern is desirable for safety as well as the appeal it has for competing in sporting events and tournaments as well as leisure play activities.

1 Claim, 1 Drawing Sheet

BOOMERANG WITH CONSISTENTLY ACCURATE FLIGHT AND RETURN CAPABILITIES

FIELD OF INVENTION

This invention relates generally to a flying boomerang with aerodynamic characteristics that make it suitable and desirable to be used, either as a game or for competitive sport activities.

BACKGROUND OF THE INVENTION

It is believed that boomerangs originated in Australia and were first used for hunting food and as a weapon for defense. The objective was, if the target was missed, the boomerang would return to the general vicinity from which it was thrown and could quickly be retrieved and used again. As more advanced weapons were developed, the art of throwing boomerangs began to take the form of a game and later became a competitive sport. As the interest in competitive sports increased, the desire to achieve the optimum flight and return pattern of boomerangs prompted many new designs in shape and form. Any flying object can be somewhat hazardous, therefore, safety also became a significant factor in the design and the flight pattern of boomerangs.

SUMMARY OF THE INVENTION

This invention relates to a boomerang with a periphery consisting of three convolute curved blades, said blades having the identical shape and being equally spaced about a central axle; each blade incorporating certain airfoil design characteristics, which, when said boomerang is thrust outwardly in a vertical position, it will create and maintain a consistent and accurate forward flight pattern from the point of launching and subsequently begin an upward fligt until it momentarily stalls in the air, then simultaneously moving slightly to the left, makes a 180 degree turn, changes from a vertical to a horizontal, hovering type flight pattern, reverses its forward flight and slowly returns to the point of launching; the consistency, accuracy and slower return of the flight pattern is particularly desirable for user safety and is quite eye appealing to observe.

The convolute curves and unique airfoil characteristics of this invention, reduces drag, provides greater lift and obtains optimum inertia, all of which significantly improves the flight and return pattern making it considerably easier for amateurs to learn how to throw and catch said boomerang. It also makes a more desirable boomerang for professionals to use when engaging in highly competitive sporting activities, events and tournaments. The general objective of any boomerang is the launching of a flying object and since any flying object can be somewhat dangerous, the consistency, accuracy and slower return of the flight pattern of this invention, along with the ease for amateurs to learn the art of throwing and catching this boomerang, significantly increases the safety of users and bystanders.

BRIEF DESCRIPTION OF THE DRAWINGS

FIG. 1 also illustrates a smooth transition along the peripheral edge of said boomerang from one curve to another with no sudden, sharp or dramatic changes in direction.

DESCRIPTION OF THE PREFERRED EMBODIMENT

Figure 1:
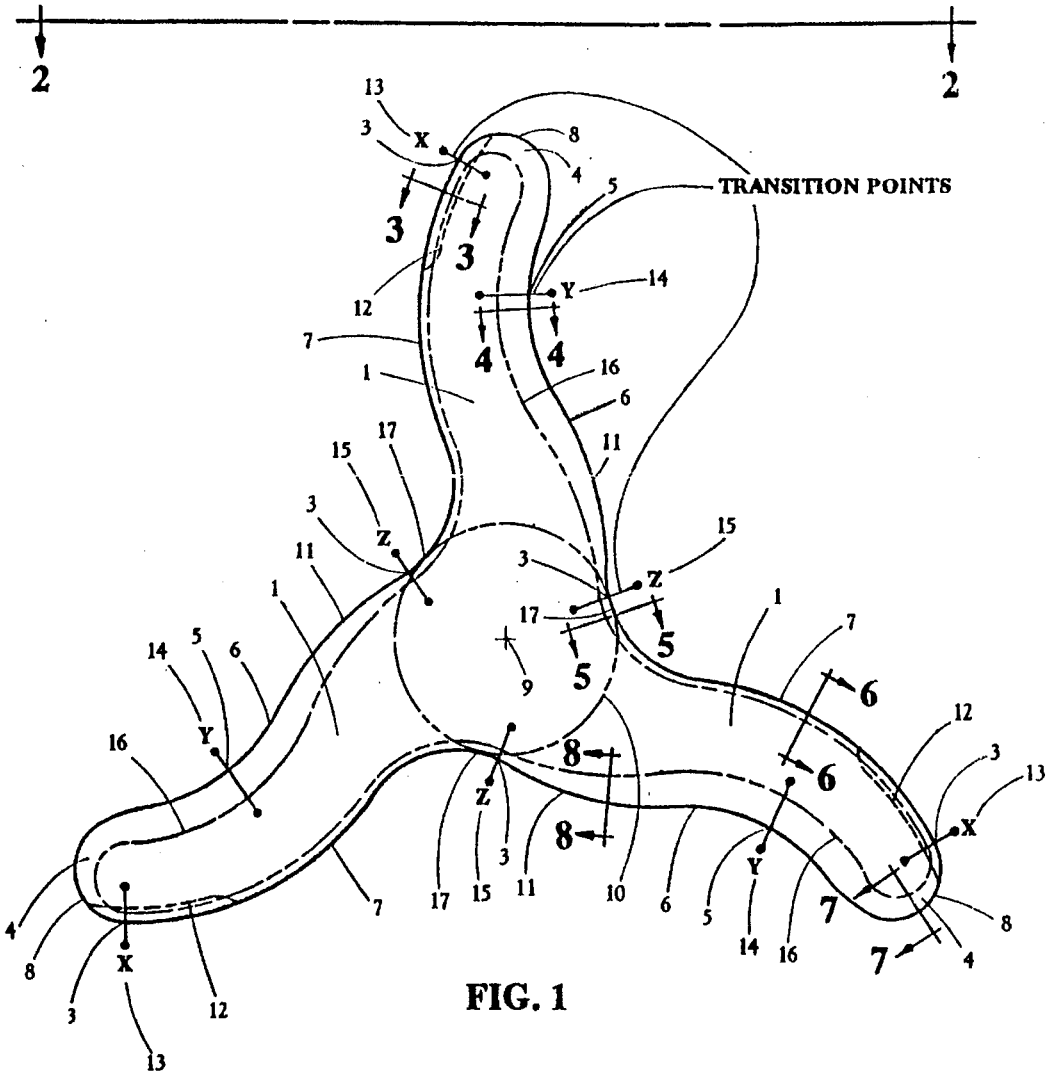
FIG. 1 is a top plan view of the preferred embodiment illustrating the periphery of the convolute curves of the three equally spaced and identically shaped blades, each blade containing unique airfoil characteristics on the top side of the boomerang that change in size and shape at transition points "X", "Y", and "Z", which are identified on the drawing as numbers 13, 14 and 15, said changes gradually go from a radius to an angular design and are shown by lightly drawn phantom lines consisting of relatively long lines followed by two short lines and are identified on the drawing as number 16.
Figure 3:
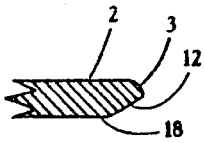
FIG. 3 is a cross sectional view taken along lines 3—3, near transition point "X", which shows a radius airfoil design on the top side and an angular airfoil design on the bottom side of said boomerang.
Figure 4:
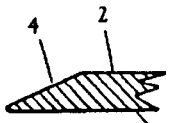
FIGS. 4, 5, 6, 7 and 8 are cross sectional views taken along lines 4—4, 5—5, and 6—6, 7—7 and 8—8 of one of the three blades shown on FIG. 1, and further illustrates the change in the unique airfoil characteristics of each blade and the changes that have taken place at said points.
Figure 5:
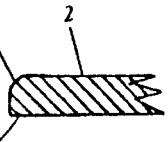
Figure 6:
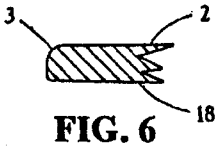
Figure 7:
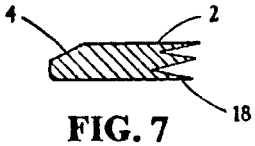
Figure 8:
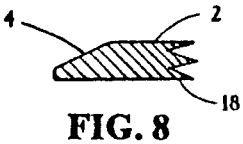

FIG. 1 illustrates the basic design and shape of the instant invention which can be generally described as a boomerang with three convolute curved blades, said blades being identically shaped and equally spaced about a central axis, each blade containing specific airfoil characteristics.

The general design of this invention has been found to be particularly effective for maintaining a consistent and accurate forward flight pattern from the point of launching until it subsequently begins an upward flight until it momentarily stalls in the air, then makes a 180 degree left turn, reversing its forward flight and simultaneously rotates 90 degrees from vertical, takes on a horizontal, hovering type of flight pattern, and returns at a much slower pace, to the point of launching; said consistency and accuracy of the forward and return flight pattern are preeminent characteristics to enhance the performance when this invention is used by professionals in highly competitive sporting events and activities.

The general design of the convolute curves and smooth transition, along the peripheral edge of said boomerang, from one curve to another with no sudden, sharp or dramatic changes in direction in conjunction with the unique airfoil design on the top and bottom sides of said boomerang, significantly reduces drag, provides greater lift, improves the hovering characteristics and enhances the aerodynamic capabilities, thereby achieving a longer, safer and consistently accurate and highly desirable flight pattern, however, other somewhat similar designs using varying degrees of convolute curves and sizes of blades, can also achieve satisfactory flight results.

The smooth transition from one curve to another, as shown on FIG. 1, is further illustrated by the rounded, outer end of each blade, identified as number 8, and by a hump or an enlargement, on the trailing edge of each blade, identified on the drawing as number 11.

Other advantages to the design of this invention consist of, but, are not limited to the following cited examples:

The ease for amateurs to learn the art of throwing and catching this type of flying boomerang.

Since all flying objects are somewhat hazardous, the slow return and consistent accuracy of flight are significant contributing factors which result in increased safety to the user and to bystanders each time this invention is thrown.

The forward and return flight created by this invention has intriguing eye appeal and is quite interesting to observe.

Referring to FIG. 1, each of the three blades #1 are uniformly shaped and have a leading edge, identified by the #7 and a trailing edge, identified by the #6. Each blade is equally spaced and connected to a central hub. Said central hub is shown on FIG. 1 as a circle, represented by lightly drawn lines consisting of a series of relatively long circular lines followed by two short lines, identified on FIG. 1 as #10. The center point of said central hub, shown on FIG. 1 by the following mark "+", is the center point of this invention and is referred to as the center axis, identified as #9. Said central hub is contained within the periphery of the convolute curves and restrained by the tangent point of the convolute curve of each of the three blades; more specifically, the center hub begins at the point where the convolute curves traverse closest to the center axis, and is identified as #17.

Referring to FIG. 1, because the airfoil shape and contour blends from an angle to a flat surface on the top side #2 by a radius, there are no distinct lines to be seen, therefore, said contour is shown in phantom lines which consist of a series of relatively long, lightly drawn lines, followed by two shorter lines. Said aifoil phantom lines extend around the entire periphery of the boomerang and is identified as #16. There are also three transition points in the airfoil design on each blade, represented by the letters "X", "Y" and "Z". "X" is identified as #13, "Y" is identified as #14 and "Z" is identified as #15. Starting with any blade, the airfoil shape and contour traverses from transition point "X" in a clockwise direction and continues along the peripheral edge of said boomerang in said clockwise direction, with said airfoil shape and contour gradually changing from a radius to an angle. The airfoil characteristics can be better illustrated by applying dimensions to the changes in the airfoil design. The following dimensions are to be used for examplar purposes only and should not in any way be considered to limit or constrain the airfoil design from one transition point to another. As an example, starting the airfoil characteristics at transition point "X" on the leading edge of any blade using a one eight (⅛) inch radius on the top peripheral edge #3, said radius will gradually change to a 26 degree angle #4 whereby at transition point "Y" #5 on the trailing edge of said blade, the angle reaches its greatest width, say 7/16 of an inch in width, at which point said angle #4 then begins to gradually change back to a radius #5 whereby at transition point "Z", located on the trailing edge of said blade; said airfoil contour again becomes a true ⅛ inch radius #4, and remains a true one eight (⅛) inch radius #4 as it continues traversing along the peripheral edge in a clockwise direction until it reaches the next transition point "X" on the leading edge of the next blade; said shape and contour changes occur on each blade until the entire peripheral edge of said boomerang is encompassed; said changes in the airfoil contour design on the top side #2 of the boomerang, in conjunction with a 30 degree angular aerodynamic airfoil characteristic #12 three sixteenth (3/16th.) of an inch wide and one and seven eights (1⅞) inches in length on the bottom side #18 of each blade, located at the outer tip on the leading edge of each blade, identified as #11; are essential functions used to produce the desired forward and return flight pattern.

Various, experimental working models have shown that combining the appropriate size and shape of the unique airfoil design on the top #2 and bottom #18 sides of the boomerang, along with the central hub 10, the enlargement #11 and the smooth transition from one curve to another, are all contributing factors to achieving the most effective and desirable aerodynamic functions needed to produce a consistent, accuracte and safe forward and return flight pattern. The sizes and shapes, as shown in FIG. 1 of the drawing of the instant invention, have been quite effective in achieving said desirable flight pattern.

Figure 2:
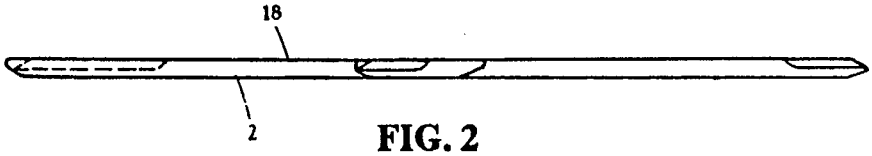
FIG. 2 is an end view of FIG. 1 taken from lines 2—2 and shows that both sides, top and bottom, are flat except along the peripheral edges where a combination of either angular airfoil characteristics or rounded edges are incorporated to achieve the desired flight pattern.

Although the top #2 and the bottom surfaces #18, as shown in FIG. 2, are essentially flat, both surfaces have airfoil contours along the peripheral edges of said boomerang. As shown in FIG. 1, said changes on the top side #2 of the boomerang are continually changing from one transition point to another. The change in the airfoil characteristics from transition points "X", "Y" and "Z" are best illustrated by the cross sectional views shown in FIGS. 3, 4, 5, 6, 7 and 8. Slight alterations or modifications to the airfoil design shown, can be made without any noticeable or significant change in the flight pattern.

The design illustrated in FIG. 1, is generally referred to as a right handed boomerang even though it subsequently makes a left turn of 180 degrees and returns to the point of launching. When a boomerang is thrown by a right-handed individual, it is generally somewhat easier to catch if the return flight is coming from a leftwardly direction. If a left handed boomerang of the same design is desired, it can be accomplished by changing or reversing the airfoil characteristics as illustrated in the cross sectional views in FIG. 3, FIG. 4 and FIG. 5, and currently shown on the top and bottom sides of the immediate invention, to the opposite or opposing sides; the top becomes the bottom and the bottom becomes the top. A left handed boomerang would subsequently make a 180 degree turn to the right before returning to the point of launching.

Considering the ease and accuracy of throwing the instant invention, the overall size of said invention lends itself quite well for the average amateur as well as most professionals. Present working models consist(s) of a blade length that extends outward from the center axis for 7 inches, thereby creating a circular spinning diameter of 14 inches. However, this does not preclude the use of smaller or larger models. There is no significant change in the general flight pattern when proportionately increasing or decreasing the overall size. However, larger models appear to require greater launching thrust in order to achieve an equal flight pattern.

All currently existing, working models of the instant invention have been made from high grade plywood with a thickness of one quarter of an inch. However, it is believed that any light weight, durable and resilient material, such as aluminum, plastic or other light weight, durable composition will perform as well or better than wood and could be more cost effective to manufacture.

While this invention has been describe with the presently preferred embodiment, many modifications of structure, proportions, material or elements can be used without departing from the general scope or principles of this invention.

What is claimed:

1. A boomerang comprising:

a substantially flat top and bottom side connected by a peripheral edge defining a thickness and forming a peripheral bottom edge where the bottom side meets the peripheral edge and a peripheral top edge where the top side meets the peripheral edge, a plurality of blades, having a leading edge, trailing edge and outer end, being arranged about a central hub in a radial fashion, the blades having an airfoil shape defined by a varying the peripheral top and bottom edge configuration wherein the top edge configuration at a central hub portion of the blade on its leading edge has a radius and the bottom edge configuration is substantially 90 degrees, at a point about the periphery distant from the outer end said 90 degree bottom edge configuration changes to an angular shaped bevel and continues for a distance along the periphery towards the outer end, at a point about a periphery of the outer end the radius of the top edge gradually changes to an angled bevel and said bottom edge changes back to a substantially 90 degree configuration, said top edge angled bevel having a width that increases then decreases as one progresses along the trailing edge periphery towards said central hub, and gradually said top edge angled bevel turns into a radius as the periphery of the trailing edge approaches the central hub.

* * * * *